United States Patent [19]

Canalizo

[11] 4,441,861

[45] Apr. 10, 1984

[54] WELL PRODUCTION APPARATUS AND METHOD

[76] Inventor: Carlos R. Canalizo, 10511 Allegheny Dr., Dallas, Tex. 75229

[21] Appl. No.: 282,138

[22] Filed: Jul. 10, 1981

[51] Int. Cl.[3] ..... F04F 5/00

[52] U.S. Cl. ..... 417/54; 417/172

[58] Field of Search ..... 417/172, 80, 81, 82, 417/360, 54; 166/106, 372

[56] References Cited

U.S. PATENT DOCUMENTS

| | | | |
|---|---|---|---|
| Re. 21,893 | 9/1941 | Horvath | 417/172 |
| 2,290,141 | 7/1942 | Burt | 166/106 |
| 3,005,494 | 10/1961 | Daffin | 166/106 |
| 3,551,074 | 12/1970 | Stout | 417/172 |
| 4,135,861 | 1/1979 | Brown et al. | 417/172 |
| 4,171,934 | 10/1979 | Zehren | 417/360 |
| 4,285,638 | 8/1981 | Clark | 417/172 |

*Primary Examiner*—William L. Freeh
*Assistant Examiner*—Paul F. Neils
*Attorney, Agent, or Firm*—H. Mathews Garland

[57] ABSTRACT

A method and apparatus for pumping a well using a jet pump. The method comprises pumping a power fluid downwardly in a first flow path in a well, directing the power fluid along a second flow path through a jet pump back to the surface, introducing produced fluids into the jet pump from below the pump, mixing the produced fluids with the power fluid in the pump, and pumping the fluid mixture to the surface through the second flow path along a substantially straight line from the zone of mixing in the pump. The apparatus includes a jet pump having a housing provided with a central bore closed at a lower end and having a transverse bore opening into the lower end of the central bore for admission of power fluid, a nozzle body and nozzle in the central bore above the transverse bore, a throat and diffuser in the bore above the nozzle, flow passages into the housing from the lower end of the housing around and separate from the transverse bore and an annular entry passage from the bypass flow passages into the housing bore between the nozzle and the throat for admission of produce fluids into the housing bore downstream from the nozzle in response to a low pressure in the throat produced by the nozzle. The nozzle body, nozzle, throat, and diffuser of the jet pump are arranged in tandem along a straight line axis.

10 Claims, 6 Drawing Figures

WELL PRODUCTION APPARATUS AND METHOD

This invention relates to apparatus and a method for well production and more particularly to production apparatus and a method using a jet type pump.

Jet type well pumps operated by a power fluid have been used for many years for producing water wells and oil wells. The power fluid used to operate the pump is supplied through a nozzle in the pump which converts the pressure head into a high velocity jet. The high velocity jet entrains the production fluids which are lifted to the surface with the power fluid. A number of different jet pump systems have been used for the production of well fluids. Included in these systems are two different types of jet pumps. In one type of jet pump the power fluid flows downwardly in the pump entraining the produced fluids in the downwardly flowing jet stream. In another form of jet pump the power fluid flows upwardly entraining the produced fluids in the upward flowing stream. In each of these prior art jet pump systems, however, crossover devices are used to ultimately direct the power fluid and the entrained produced fluids upwardly in the well bore toward the surface. Prior art systems have employed such crossover devices in both casing-tubing annulus type systems and in systems using H-members in parallel tubing strings in which the power fluid flows downwardly in one string and back upwardly with the produced fluids in a second string in the well bore. The crossover devices employed in both types of well production systems require that the stream of power fluid with entrained produced fluids change directions one or more times resulting in direct impingement of the flow stream on inside wall surfaces of the crossover device. Produced well fluids often include solid material such as sand. Each time that the power fluid and produced fluid stream changes direction each inside wall surface of the crossover device is subjected to direct pump blast erosion which substantially reduces the useful life of the crossover device. Obviously when a crossover in a well system such as an H-member and the crossover device in a casing-annulus system fails, it is necessary to remove the system, replace the crossover device and reinstall the system. Removal and reinstallation of all of the production equipment in a well which is required in such a failure is extremely expensive and time consuming. It has been found that in a system which incorporates the features of the present invention using a jet pump power fluid stream with entrained produced fluids directed along a flow path which does not involve direction changes, results in a very significant longer life of the crossover devices and thus eliminates the necessity to pull the production equipment from the well and replace it as has been found to be required in existing prior art jet pump systems.

It is therefore a principal object of the invention to provide new and improved method and apparatus for jet pump production of wells.

It is another object of the invention to provide method and apparatus for jet pump production of wells in which change of flow direction of the produced well fluids is not required.

It is another object of the invention to provide a jet pump system for wells in which the power fluid is flowing in an upward direction when the produced fluids are entrained in the power fluid.

It is another object of the invention to provide a jet pump system in which the pump may be installed and retrieved by either a conventional wireline system or a hydraulic pumpdown system in which tool trains including seal units or locomotives are pumped to and from the crossover device in which the jet pump is installed.

In accordance with the present invention, there are provided a method and apparatus for jet pump production of wells. The method of the invention includes the steps of pumping jet pump power fluid downwardly in a well bore along a first flow passage, directing the power fluid into and upwardly through the bore of a nozzle and outwardly from the nozzle increasing the velocity of the power fluid and reducing the pressure therein, entraining well production fluids into the stream of power fluid downstream from the nozzle outlet, flowing the power fluid and entrained well production fluids along a larger bore in a throat wherein the velocity of the produced fluids is increased to that of the power fluid, flowing the power fluid and entrained produced fluids into a diffuser wherein the velocity of the fluids is decreased and the pressure increased and flowing the power fluid and produced fluids to the surface through a second flow passage along the well bore. The stream of power fluid and produced fluids flows along a substantially straight flow path without changing direction. Further, in accordance with the invention, there is provided a jet pump production system for a well including a jet pump housing having lateral inlet ports near a lower end thereof, a nozzle having a central bore having a lower inlet communicating with the inlet ports and opening at a reduced upper end, a throat having a central bore having a lower end communicating with the discharge end of the nozzle and spaced above the nozzle defining a production fluid entrainment flow passage communicating with flow passages within the housing around the nozzle extending to a production fluids inlet below the nozzle, the throat central flow passage being aligned with the flow passage through the nozzle and opening upwardly into a diverging central flow passage through a diffuser aligned with the flow passage through the throat, and the diffuser opening at an upward enlarged end thereof into a central discharge flow passage aligned with the diffuser flow passage for discharging power fluid and entrained production fluids from the jet pump into a production tubing leading to the surface. The jet pump is releasably locked in a crossover device of either an H-member or a casing-tubing annulus member in a well bore providing a power fluid flow passage leading from the surface to the crossover device and a separate production fluid flow passage leading from the jet pump and crossover device to the surface. A locking recess is provided along the production fluids flow passage to the surface for releasably locking a locking mandrel coupled with the jet pump. The jet pump parts are arranged providing a central flow passage through the pump from the point of entry of the produced fluids to the discharge of the pump through the throat and diffuser which permits straight line flow of the power fluid and produced fluids without any change of direction thereby avoiding direct pump blast erosion on any of the internal surfaces of the pump and crossover device.

The foregoing objects and advantages of the invention as well as the specific details of preferred embodiments thereof will be better understood from the following detailed description taken in conjunction with the accompanying drawings wherein.

Figure 3A:
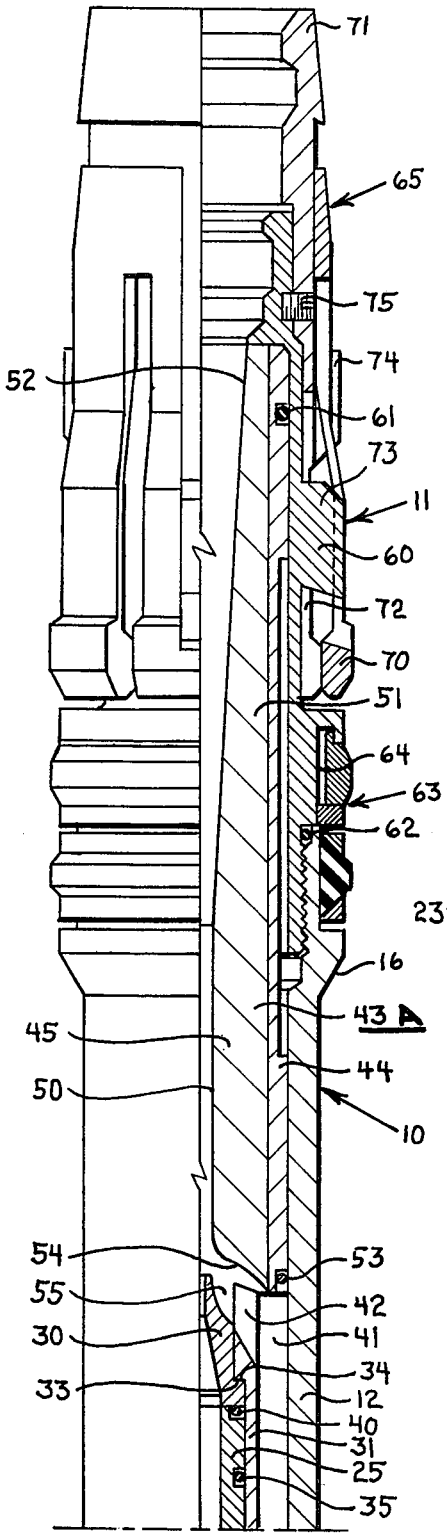
Figure 3B:
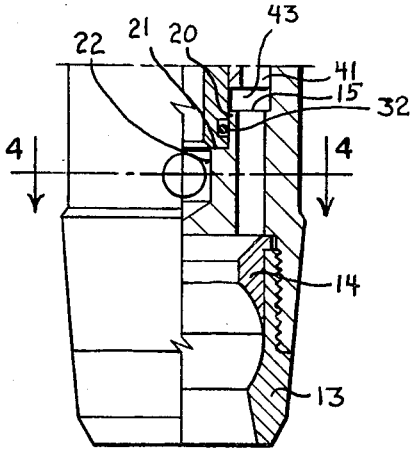
Figure 4:
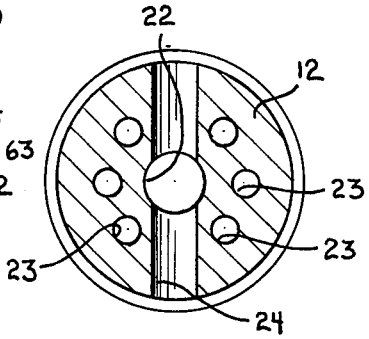

FIGS. 3A and 3B taken together form a longitudinal view in section and elevation of a jet pump embodying the features of the invention connected with a locking mandrel for releasably locking the pump in a crossover device in a well bore;

FIG. 4 is a view in section along the line 4—4 of FIG. 3; and

Figure 5:
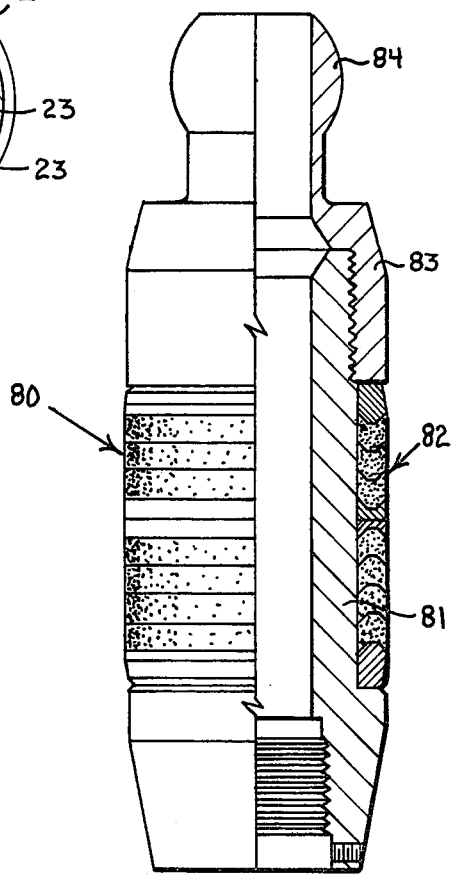

FIG. 5 is a longitudinal view in section and elevation of a lower packing mandrel assembly for use with the jet pump as shown in FIGS. 3A–3B.

Figure 1:
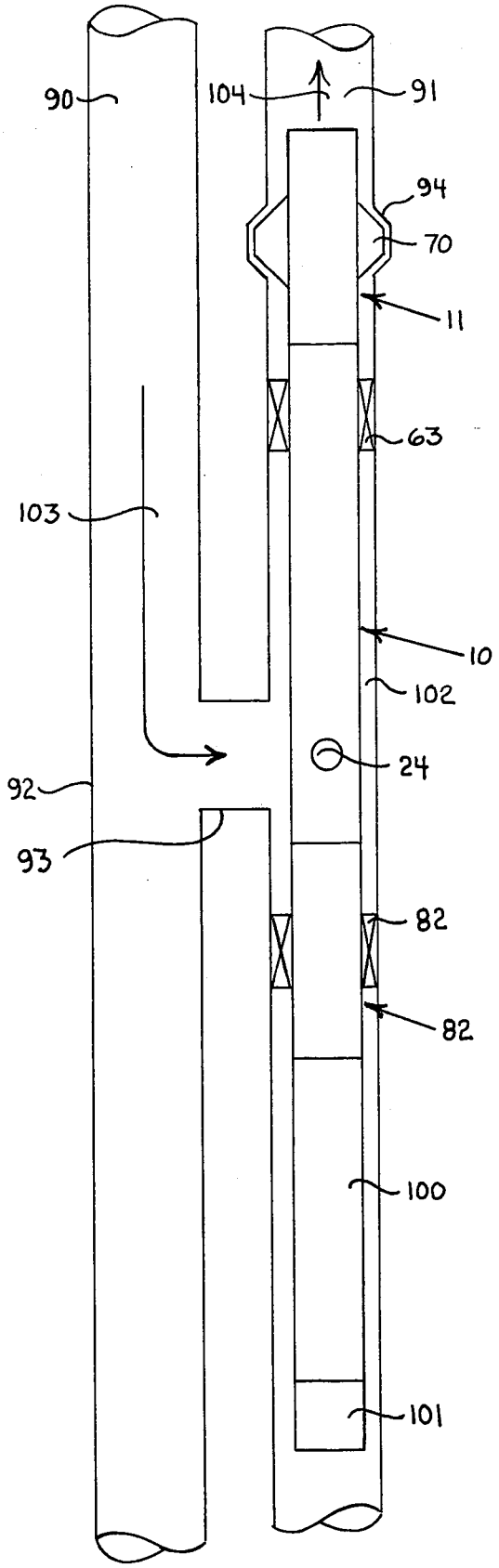
FIG. 1 is a fragmentary schematic view in section and elevation of a jet pump system installed in an H-member connecting parallel tubing strings for use in a well bore in accordance with one embodiment of the invention.
Figure 2:
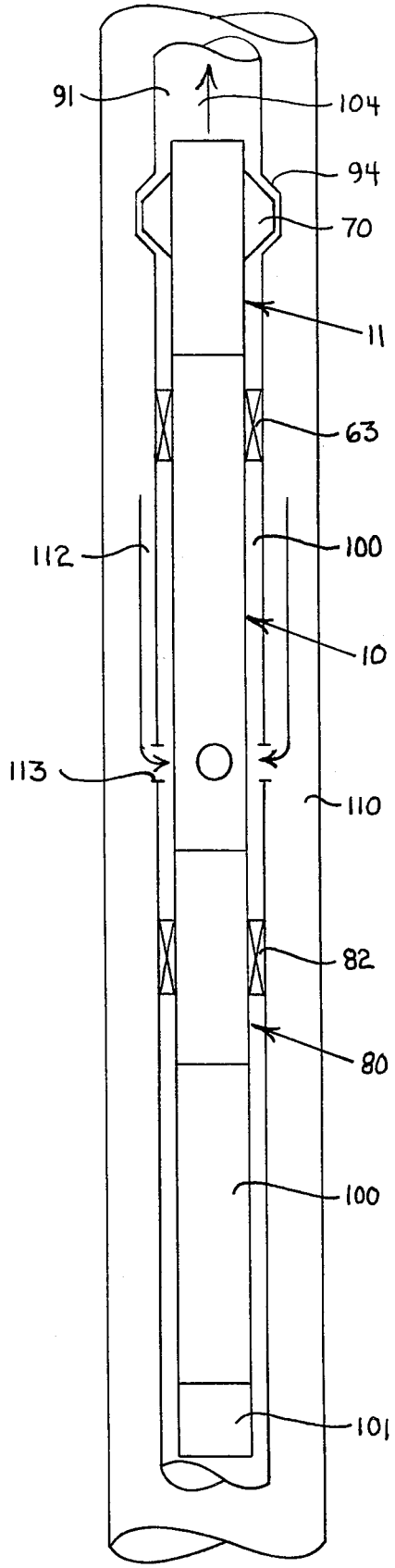
FIG. 2 is a fragmentary schematic view in section and elevation of a jet pump system installed in a crossover device between a well casing and a well production tubing in accordance with the invention.

Referring to FIGS. 3A–3B, a jet pump 10 embodying the features of the invention is connected with a locking mandrel assembly 11 for releasably locking the jet pump in either of the well production systems illustrated in FIGS. 1 and 2. The pump has a housing 12 connected along a lower end portion with a sub 13 for coupling the housing with the packing mandrel of FIG. 5. An annular bearing member 14 is secured at the lower end of the housing within the sub 13.

Referring to FIGS. 3A and 3B, the lower portion of the jet pump housing 12 has a graduated or stepped blind bore which includes an upwardly facing internal annular shoulder 15, a vertical portion 20, an internal annular shoulder 21 at the lower end of the vertical portion 20, and a blind bore lower end portion 22. Referring to FIG. 4, the lower end portion of the pump housing 12 has a plurality of circumferentially spaced vertical bores 23 which open at upper ends through the surface 15 and at lower ends through the lower end of the housing into the bore through the bearing member 14 and the bottom sub 13 for upward flow of production fluids into the jet pump housing. A lateral bore 24 is formed in the lower portion of the pump housing 12 opening into the blind bore portion 22 within the housing for the flow of power fluid into the jet pump. A tubular nozzle body 25 and a nozzle 30 arranged in tandem with the body 25 are supported within a tubular mounting sleeve 31 fitted in the pump housing 12. The lower end portion of the nozzle body 25 is engaged within the pump housing bore portion 20. The lower end edge of the body 25 rests on the annular shoulder 21 within the pump housing. A ring seal 32 within an external annular recess around the body 25 seals between the body and the surface defining the pump housing bore portion 20. The mounting sleeve 31 has an internal annular support shoulder 33 which engages an external annular support shoulder 34 on the nozzle 30. External annular seals 35 and 40 within longitudinally spaced external annular recesses along the nozzle body 25 seal between the nozzle body and the bore of the sleeve 31 below the sleeve shoulder 33. Thus, the nozzle body 25 is supported within the pump housing 12 on the shoulder 21; the nozzle 30 is supported on the upper end edge of the housing 25; and the mounting sleeve 31 holds the nozzle 30 in position on the body 25 while being supported on the nozzle by the nozzle shoulder 34. The sleeve 31 has a plurality of longitudinal circumferentially spaced bores 41 which open through the lower end of the sleeve and communicate at upper ends with longitudinal circumferentially spaced slots 42. An annular flow space 43 is defined within the pump housing 12 around the nozzle body 25 between the lower end of the sleeve 31 and the shoulder surface 15 of the housing 12. Produced well fluids pass upwardly from the bore through the sub 13 and the bearing member 14 into the flow bores 23 into the annular space 43 from which the produced fluids flow upwardly in the bores 41 of the sleeve 31 and inwardly through the slots 42 around the upper end of the jet nozzle 30.

As shown in FIG. 3A, a tubular member 43A is mounted within a sleeve 44 in the pump housing 12. The member 43 has a lower throat portion 45 which has a uniform diameter bore 50 and an upper diffuser portion 51 having an upwardly divergent bore 52 communicating at a lower end thereof with the upper end of the throat bore 50. The lower end edge of the sleeve 44 is engaged with the upper end face of the sleeve 31 holding the sleeve 31 on the nozzle body 25 and the nozzle 30. An annular seal 53 in an external annular recess at the lower end of the sleeve 44 seals between the sleeve and the inside bore surface of the pump housing 12. The lower end of the member 43A has a downwardly and outwardly flared end surface 54 which is spaced from the nozzle 30 and from the upper end of the sleeve 31 providing an annular inlet 55 for the inflow of produced fluids around the nozzle.

A tubular locking mandrel body 60 is threaded along a lower end portion into the upper end of the pump housing 12 supporting the locking mandrel 11 on the jet pump. The sleeve 44 extends into the locking mandrel body. A ring seal 61 is mounted in an external annular recess along the upper end portion of the sleeve 44 sealing around the sleeve within the bore of the locking mandrel body 60. A ring seal 62 within the upper end of the pump housing 12 around the locking mandrel body 60 seals between the body 60 and the housing 12. A seal assembly 63 is mounted within an external annular recess 64 provided around the upper end portion of the housing 12 and the lower end portion of the locking mandrel body 60 for sealing around the jet pump within a tubing wall.

The locking mandrel 11 is a standard form of locking assembly for releasably locking well tools along a well bore such as at the upper nipple profile of an Otis H-Member such as described and illustrated at page 13 of Otis Engineering Corporation Catalog OEC 5113 entitled "Pumpdown Completion Equipment" published May 1975. The locking mandrel includes a locking collet 65 having a plurality of interconnected locking fingers 70 which expand and contract laterally for release and locking of the mandrel at the nipple profile. The locking collet 65 is mounted on and longitudinally slidable along a top handling sub 71. A plurality of circumferentially spaced downwardly extending fingers 72 are formed on the top sub for movement within the collet fingers 70 between a lower locking position as shown in FIG. 3A and an upper release position, not shown. A plurality of retainer fins 73 are formed on the locking mandrel body 60 between the fingers 70 which are interconnected at lower ends retaining the locking collet 65 on the body. Similarly circumferentially spaced retainer fins 74 along the top sub 71 at the upper ends of the fingers 72 between the collet fingers 70 are engageable with the connecting portions between the upper ends of the collet fingers 70 so that the top sub is held on the locking mandrel body. As shown in FIG.

3A top sub 71 is held by a shear pin 75 extending into the locking mandrel body 60 holding the top sub against movement on the body until release of the locking mandrel from the nipple profile is desired. The locking collet 65 is free for limited movement upwardly on the top sub so that as the locking mandrel moves downwardly in the tubing of a well the fingers 70 drag upwardly above the fingers 72 so that the fingers 70 do not lock the locking mandrel against downward movement. When the locking mandrel reaches a nipple profile the locking collet 65 drops downwardly on the top sub to the position shown in FIG. 3A so that the collet fingers 72 within the fingers 70 hold the fingers 70 outwardly at locked positions. The locking mandrel is released by an upward pull on the top sub 71 which shears the screw 75. When the top sub is lifted upwardly the inner fingers 72 are raised above the outer locking fingers 70 so that the outer fingers may collapse inwardly to release the locking collet from a nipple profile.

Referring to FIG. 5, a packing mandrel assembly 80 connectible with the lower end of the jet pump housing 12 includes a body 81 supporting an external annular seal assembly 82 secured along an upper end portion into a connecting sub 83 having a ball connector 84 which fits into the bottom sub 13 and bearing member 14 on the lower end of the jet pump as shown in FIG. 3B. The packing mandrel assembly 80 operates in conjunction with the seal assembly 63 on the jet pump body to seal off an annular space along a tubing in which the jet pump is installed for directing power fluid to the pump through the transverse bore 24 as explained in further detail in connection with the systems shown in FIGS. 1 and 2.

Referring to FIG. 1, one well production system in which the method and jet pump of the invention are used includes first and second tubing strings 90 and 91 which are interconnected at a desired depth in a well bore by an H-member 92 including a crossover connection 93 communicating the two tubing strings. The H-member is a part of pumpdown completion equipment manufactured by Otis Engineering Corporation as described and illustrated in the Pumpdown Completion Equipment catalog OEC 5113, supra. The H-member also includes a landing nipple profile 94 at which the locking mandrel 11 releasably locks the jet pump. One arrangement of production equipment which may be used as illustrated in FIG. 1 includes the jet pump 10 coupled with the locking mandrel 11 and with the packing mandrel 80, a suitable standing or check valve 100, and a screen 101. The check valve and screen are standard equipment connected with the intake end of well production tools for screening out foreign matter as production fluids flow and for allowing upward flow into the jet pump while precluding downward flow. Both the standing valve and screen are shown only by way of illustration and comprise no part of the invention. The locking mandrel 11, the jet pump 10, the standing valve 100, and the screen 101 form a tool train which is installed in the tubing string 91 by means of either wireline equipment and procedures or pumpdown equipment, both of which are well known techniques and systems. For example, in the use of wireline equipment a suitable handling tool, not shown, is connected with the top sub 71 on the locking mandrel 11 for lowering the tool train into the tubing string. Similarly when pumpdown equipment is used suitable liquid pumpable locomotives or seal units are connected with the top sub 71 for running the tool train into the tubing string. As the tool train is moved through the tubing string 91 the collet 65 is dragged upwardly to a release position above the collet fingers 72 until the locking collet assembly reaches the H-member 92 where the no-go shoulder 16 on the jet pump housing engages a no-go shoulder, not shown, within the H-member which is positioned to align the collet fingers 70 with the nipple profile 94 when the no-go shoulders engage. The collet fingers 65 then expand outwardly into the profile 94 dropping downwardly around the inner fingers 72 which prevent the collet fingers from compressing inwardly thereby locking the locking mandrel 11 at the landing nipple profile. The running tool along with the other wireline equipment or pumpdown piston units, depending upon which system is used for installing the jet pump, are then removed from the tubing string 91.

With the jet pump tool string installed in the production tubing 91 at the H-member of a well, as shown in FIG. 1, the packing assembly 63 on the jet pump housing and the packing assembly 82 on the packing mandrel 80 seal off an annular space 102 within the tubing 91 around the jet pump and packing mandrel thereby isolating the space within the tubing around the jet pump from production fluids below the packing assembly 82 in the tubing string 91 and pumped production fluids and power fluid within the tubing string 91 above the seal assembly 63. The annular space 102 provides a flow path for power fluid from the crossover member 93 to the power fluid inlet bore 24 of the jet pump. Power fluid, which may be water or oil, is pumped from the surface downwardly in the well tubing 90 to the crossover 93 along the path identified by the reference number 103. The power fluid flows laterally through the crossover 93 from the tubing 90 into the annular space 102 of the production tubing 91. The power fluid enters the jet pump 10 from the annular space 102 through the lateral bore 204 in the jet pump housing 12. The jet pump tool train is set at an H-member in the production tubing at a depth at which formation fluids in the production tubing 91 below the jet pump tool train flow through the screen 101, upwardly through the standing valve 100, and into the lower end of the jet pump through the bore of the packing mandrel 80, the bore through the sub 13 and bearing member 14 of the jet pump, and along the pump housing vertical bores 23, the bores 41 of the sleeve member 31, and inwardly around the jet pump nozzle 30 through the slots 42 into the jet pump entry passage 55, FIG. 3A. The power fluid which is being pumped at a high pressure flows upwardly in the jet pump from the lateral bore 24 through the vertical bore 22, along the nozzle body 25, and through the converging bore of the nozzle 30. The nozzle produces a high velocity jet in the power fluid discharged upwardly from the nozzle into the bore portion 50 of the throat 45. This high velocity produced in the power fluid by the jet nozzle develops a vacuum in the annular entry passage 55 and along the throat bore 50 which causes the well production fluids to flow upwardly from below the jet pump tool train along the previously described path into the jet pump throat. Within the throat the power fluid mixes with the production fluids with the fluids mixture flowing upwardly into the diverging bore 52 of the diffuser 51 in the jet pump. In the diffuser the fluids mixture progressively moves along the bore which increases in area due to the diverging configuration of the bore producing a velocity drop and a pressure increase in the fluids. A maximum pressure and minimum velocity are attained in the pumped fluids mixture as the mixture flows along the bore of the top sub 71 of the jet pump from the diffuser into the production tubing 91 above the jet pump along the line 104 shown in FIG. 1. The fluids mixture is then pumped to the surface through the production tubing 91.

A particularly important aspect of the invention is that the pumped fluids move along the jet pump into the production tubing and to the surface along a substantially straight line path. Referring to FIG. 3A, it will be evident that from the annular entry flow passage 55 around the nozzle 30 through which the produced fluids flow mixing in the throat 50 with the power fluid, there is no change of direction in the pumped fluids. From the point at which the velocity in the produced fluids increases in the throat 50 the pumped fluids follow a straight line path to the surface. A wide variety of mixtures of fluids and solids are encountered in producing wells. Those solids range in character up to highly abrasive sand particles which in prior art applications of jet pump apparatus and methods produce highly destructive erosion which causes premature failure of the well production apparatus resulting in expensive and time consuming refitting of a well. In the present method and apparatus in which the power fluid flows upwardly along the jet pump nozzle 30 entraining and thereafter displacing to the surface the produced fluids along a straight line path, any abrasive matter in the produced fluids do not impinge against production equipment surfaces. The produced fluids do not make severe turns such as complete reversals in direction or even 90° turns which are found in prior art apparatus and methods. Thus, none of the surfaces of the production equipment in a system such as shown in FIG. 1 are eroded by solids in the produced fluids due to the straight line path along which the fluids are pumped by the upwardly flowing power fluid. The only turns which are made by fluids are those of the power fluid moving along the path from the tubing string 90 into the crossover 93 to the inlet bore 24 of the jet pump. The power fluid is a clean fluid free of abrasive particles and thus turns made with the power fluid do not produce erosion along surfaces of the production equipment.

Another well production apparatus arrangement in which the method and apparatus of the invention are equally effective is shown in FIG. 2. The production tubing string is installed in a well casing 110 providing a tubing-casing annulus 111 through which power fluid is pumped from the surface along the path identified by the arrows 112. Side ports 113 in the production tubing 91 admit the power fluid to the production tubing from the annulus 111. The jet pump tool train including the pump 10, the packing mandrel 80, the standing valve 100, and the screen 101 are installed in the production tubing 91 by either pumpdown or wireline techniques in the manner previously described. The tubing annulus 100 around the jet pump housing between the packing assemblies 63 and 82 provides a flow path for the power fluid entering the production tubing through the side ports 113. The well is pumped with the jet pump using the same apparatus and method as previously described in connection with the production system shown in FIG. 1.

It will now be seen that new and improved method and apparatus for producing wells using a jet pump have been described and illustrated. The apparatus includes a jet pump releasably locked in a production tubing of a well providing an upwardly directed jet pump nozzle, throat, and diffuser and upwardly directed entry passage for production fluids so that the pumped fluids follow a straight line path from the pump to the surface. The power fluid is introduced into the jet pump where the fluid is directed upwardly entraining upwardly flowing produced fluids and pumping the fluids mixture along a straight line path thereby making no changes of direction in the flow of the pumped fluids eliminating erosion of inside surfaces of the production equipment. The method and apparatus are equally useful in pumpdown and wireline well systems. The apparatus and method also may be applied to dual tubing string arrangements using one string for power fluid and the other string for pumped fluids with the strings interconnected by a H-member. The apparatus and method are equally applicable to a production tubing-casing system using the tubing-casing annulus for the power fluid and the production tubing for the pumped fluids.

What is claimed is:

1. A jet pump assembly for producing a well comprising: a pump housing having a longitudinal bore provided with an inlet end, a transverse bore opening into said inlet end, and an outlet end for discharge into a producing flow path having an axis aligned with the axis of said housing bore; a nozzle body and a nozzle arranged in tandem in said longitudinal bore near the inlet end thereof downstream from said transverse bore for receiving power fluid introduced into said housing through said transverse bore; said nozzle body having longitudinal bypass flow passages separate from and around said transverse bore and said nozzle body and nozzle from an inlet end of said housing into said bore of said housing downstream from said nozzle for flowing producing fluids from below said pump into said pump bore downsteam from said nozzle; a throat member in said housing bore downstream from said nozzle and from the entry of said bypass flow passages for producing fluids into said housing bore; a diffuser in said housing bore downstream from said throat member; said nozzle body, said nozzle, said throat member, and said diffuser being arranged in tandem along a substantially straight longitudinal axis for substantially straight line flow of power fluid and producing fluids through said jet pump into a producing flow passage having an axis substantially aligned with said axis through said pump housing bore whereby producing fluids entrained in said power fluid through said jet pump and into said producing flow passage move along a substantially straight line path without impinging upon internal surfaces in said well; a locking mandrel assembly on said housing around said diffuser for releasably locking said jet pump along a producing fluids tubing string for producing fluids through said tubing string with said pump from below said pump into said string above said pump along a substantially straight line flow path; and a seal assembly on said housing above said transverse flow passage around said diffuser adapted to seal with the inner wall of a tubing for sealing off an annulus in said tubing around said housing to direct power fluid into said transverse flow passage.

2. Apparatus in accordance with claim 1 including parallel separate tubing strings within a well and an H-member interconnecting said tubing strings, one of said tubing strings including a landing nipple profile for releasably locking said locking mandrel assembly to support said jet pump within said tubing string with said seal assembly being positioned above a crossover in said H-member.

3. Apparatus in accordance with claim 1 wherein said locking mandrel assembly is releasably locked at a landing nipple profile provided in a producing tubing string within a well casing, said tubing string having inlet ports for introducing power fluid from said casing around said tubing string into said tubing string and said seal assembly is being engaged with the inner wall of said tubing string above said ports.

4. A jet pump assembly in accordance with claim 1 including an annular seal assembly connected on said body below said transverse bore, said seal assembly being provided with a longitudinal bore opening into said longitudinal bore of said body.

5. A jet pump assembly in accordance with claim 1 including shear pin means in said lock mandrel for holding said lock mandrel locked against upward fluid flow forces along said longitudinal bore.

6. A jet pump assembly in accordance with claim 5 including an annular seal assembly connected on said body below said transverse bore, said annular seal assembly being provided with a longitudinal bore opening into said bore of said body.

7. A method of producing a well having a bore including a first flow passage for introducing a jet pump power fluid downwardly along said bore, a second separate flow passage for producing well fluids upwardly along said bore, and a cross-over flow passage between said first and second flow passages, said method of producing comprising: introducing a jet pump into said second flow passage, said jet pump having means for discharging power fluid and produced well fluids along a substantially straight line path along said second flow passage, said jet pump including a lock mandrel and an annular seal for sealing with a surrounding wall in said bore defining said second flow passage; releasably locking said jet pump at a landing nipple along said second flow passage, said annular seal on said pump sealing around said pump with said wall above said cross-over passage; and pumping power fluid downwardly in said well bore through said flow passage, through said cross-over passage into said jet pump, and upwardly through said jet pump whereby well fluids are entrained in said power fluid in said jet pump and said power and produced well fluids are pumped in said second flow passage along a substantially straight line to the surface in said second flow passage.

8. A method in accordance with claim 7 wherein said first flow passage is defined by an annulus between a tubing string in said well bore and a casing within said well bore, and said second flow passage is within said tubing string, and flow passage cross-over means are provided between said annulus and said tubing string for introducing power fluid from said annulus into said second flow passage.

9. A method in accordance with claim 7 wherein said first flow passage is within a first tubing string in said well bore and said second flow passage is within a second tubing string in said well bore, and said tubing strings are interconnected for introduction of said power fluid into said second flow passage from said first flow passage for operating said jet pump.

10. A method in accordance with claim 9 wherein said tubing strings are substantially parallel separate laterally spaced tubing strings within said well bore.

* * * * *